US005957529A

United States Patent [19]

Schrewe

[11] Patent Number: 5,957,529

[45] Date of Patent: Sep. 28, 1999

[54] SEATING SYSTEM, ESPECIALLY FOR MULTISEAT BENCHES

[75] Inventor: Klaus Schrewe, Brilon-Bontkirchen, Germany

[73] Assignee: Mauser Office GmbH, Korbach, Germany

[21] Appl. No.: 09/076,930

[22] Filed: May 13, 1998

[30] Foreign Application Priority Data

May 23, 1997 [DE] Germany ..... 197 21 559

[51] Int. Cl.[6] ..... A47C 15/00

[52] U.S. Cl. ..... 297/232; 297/173; 297/240

[58] Field of Search ..... 297/232, 173, 297/240, 241, 249, 256

[56] References Cited

U.S. PATENT DOCUMENTS

| | | | |
|---|---|---|---|
| 2,445,240 | 7/1948 | Paden | 297/241 |
| 3,002,787 | 10/1961 | Ziegenfuss | 297/249 |
| 4,662,679 | 5/1987 | Franck et al. | 297/240 |
| 5,292,177 | 3/1994 | Balderi et al. | 297/232 |
| 5,437,495 | 8/1995 | Wu | 297/240 X |
| 5,470,128 | 11/1995 | Kerkham | 297/232 |
| 5,671,975 | 9/1997 | Muller | 297/232 X |

*Primary Examiner*—Peter M. Cuomo
*Assistant Examiner*—Stephen Vu
*Attorney, Agent, or Firm*—Herbert Dubno

[57] ABSTRACT

A plurality of seating units, each of which may have two or more seats on a common frame, can be connected to a central support by plug connectors. The central support has a support column and a housing which can be clamped together upon angular adjustment to allow the seating units to assume various angles relative to one another. The central column can accommodate an approximately round table.

15 Claims, 4 Drawing Sheets

50
51
52
54
53
11
4
8
2
7
1
6
3
9
5

3
23
6
2
3
3

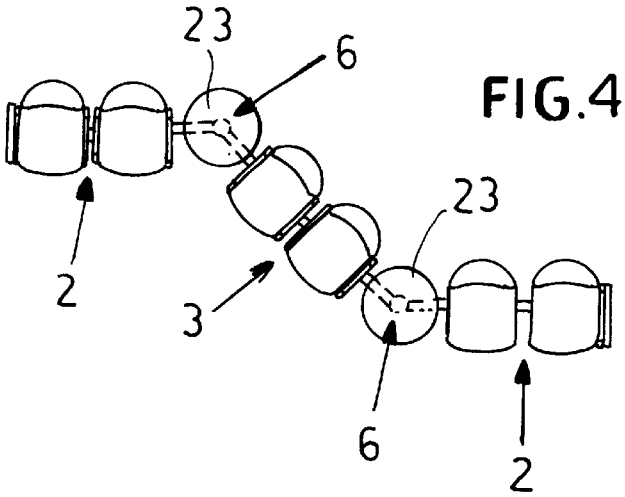
FIG.4
FIG.5
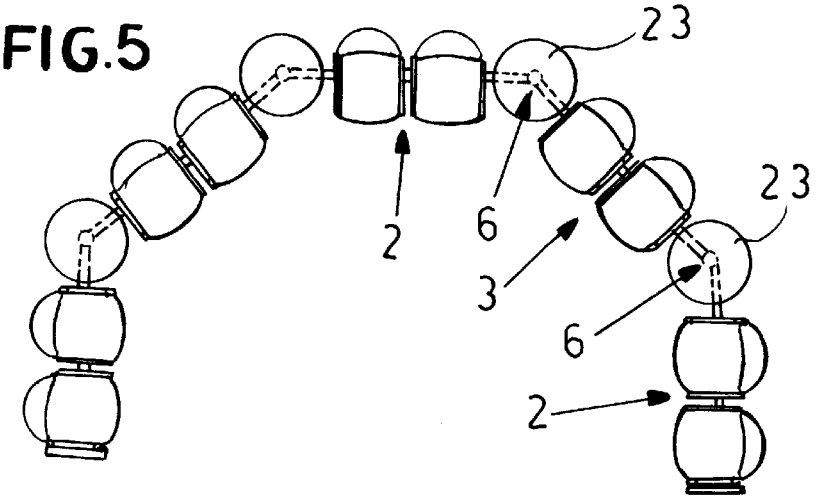
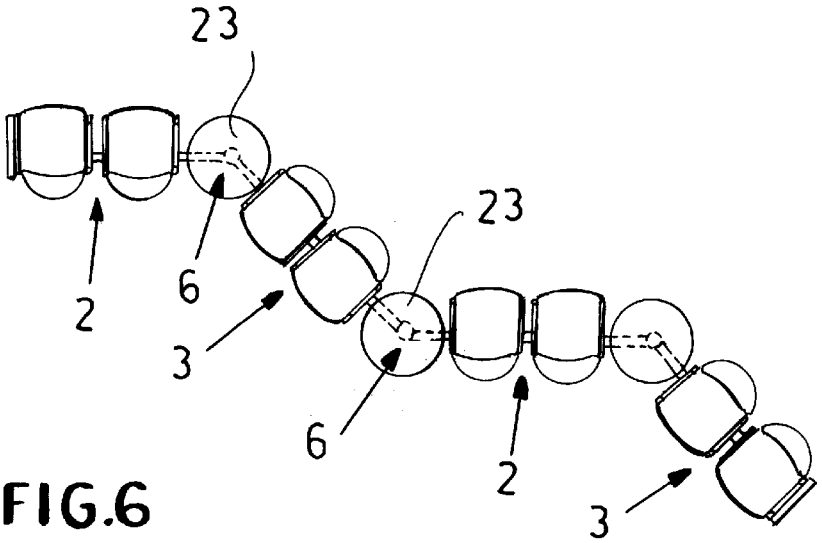
FIG.6

SEATING SYSTEM, ESPECIALLY FOR MULTISEAT BENCHES

FIELD OF THE INVENTION

My present invention relates to a seating system of the type in which a plurality of seating units, especially multiseat benches, have a common support between them.

BACKGROUND OF THE INVENTION

Row-type seats, i.e. seating units having a plurality of seats on a common frame, can be arranged individually or in groups, and can be provided with a table or the like between them and connected with that table, in a seating system. Seating systems of this type have been widely used in public places, for example, in office facilities, museums, schools, offices and reception rooms of medical practitioners and hospitals, wherever a number of people are awaiting service or attention.

Frequently it is desirable that the seating units or benches be arranged at an angle to one another and in the past that has required specific constructions or assemblies of the units. In some cases, in the past, the assemblies have been such that they were not able to prevent one bench from slipping relative to the other bench.

Naturally, where a plurality of seating units were provided on a common frame construction or had rigidly interconnected frame constructions, a fixed relationship of the seating units was provided and hence versatility in seating was lost or severely limited.

OBJECTS OF THE INVENTION

It is the principal object of the present invention to provide a seating system of the type described which has a relatively simple but yet stable or robust construction and a high degree of versatility with respect to orientation of the seating units so that the assembly can be provided in a wide variety of configurations and mutual orientations of the seating units.

Another object of this invention is to provide a seating system of the type described, i.e. having two or more seating units with a table construction between them, whereby drawbacks of earlier systems can be avoided.

Still another object of this invention is to increase the versatility of a seating system, especially for reception rooms, public spaces and the like, particularly to permit freely selectable angular orientations of bench or row-type seating units of such a system.

SUMMARY OF THE INVENTION

These objects and others which will become apparent hereinafter are attained, in accordance with the invention in a seating system which comprises:

a support defining a vertical axis;

at least two seating units connected to the support and adjustable angularly thereon about the axis to form a freely selectable angle between the seating units; and means on the support for locking the seating units relative to one another and to the support at the angle.

The seating units, which can be benches formed by respective rows of individual seats on a common frame, thus can have their ends turned toward one another interconnected by a support forming a joint enabling the two seating units to assume a freely-selectable angle about the vertical axis and to be locked in the selected angular orientation. By providing a pivot joint between seating units which can be identical or different, i.e. can have a seam or different numbers of seats and can have the seats in the same or different orientations, the system of the invention greatly facilitates the machining of the system to a particular space and thus provides a highly versatile seating for public spaces and for patients in health facilities. The interconnection of the seating units with a common joint which can be locked to establish the angular orientation of the seating units at a column at which the seating units are braced against the floor, provides a high degree of stability for the system.

The freely selectable angular orientation for the seating system allows a number of such systems to be oriented in rows or even in a more or less circular or polygonal pattern or in a radial or star orientation. Indeed, practically any pattern of adjoining seating systems can be provided because of the high degree of versatility afforded by the seating system of the instant invention.

According to a feature of the invention, the support comprises a support column which is rigidly secured to a first of the seating units and a support housing coaxial with that column and rigidly connected with a second of the seating units. Between the column and the housing a clamping arrangement is provided to lock the housing and the column in a selected angular relationship. Such a pivot system not only allows relatively facile assembly of the seating system but enables seating systems to be oriented in a wide variety of patterns and ensures support of the seating systems without large bases or feet. The appearance of the systems is thus likewise improved.

It has been found to be advantageous for rapid assembly of the seating system to connect the seating units with the column or housing by plug connectors which can fit detachably into the respective frames of the seating units. The plug connectors can be secured to the frames by screws or bolts. The resulting construction is of a comparatively low cost and allows one seating unit to be reversed relative to the other simply by the fitting of the opposite end of that seating unit's frame with the respective plug connector. The clamping device can be a bolt or screw traversing end plates of the housing and of the column and, advantageously, passing through a sleeve braced between these end plates.

BRIEF DESCRIPTION OF THE DRAWING

The above and other objects, features, and advantages will become more readily apparent from the following description, reference being made to the accompanying drawing in which:

FIGS. 4–6 are plan views showing various orientations of assemblies using different numbers of seating units and respective supports.

SPECIFIC DESCRIPTION

Figure 1:
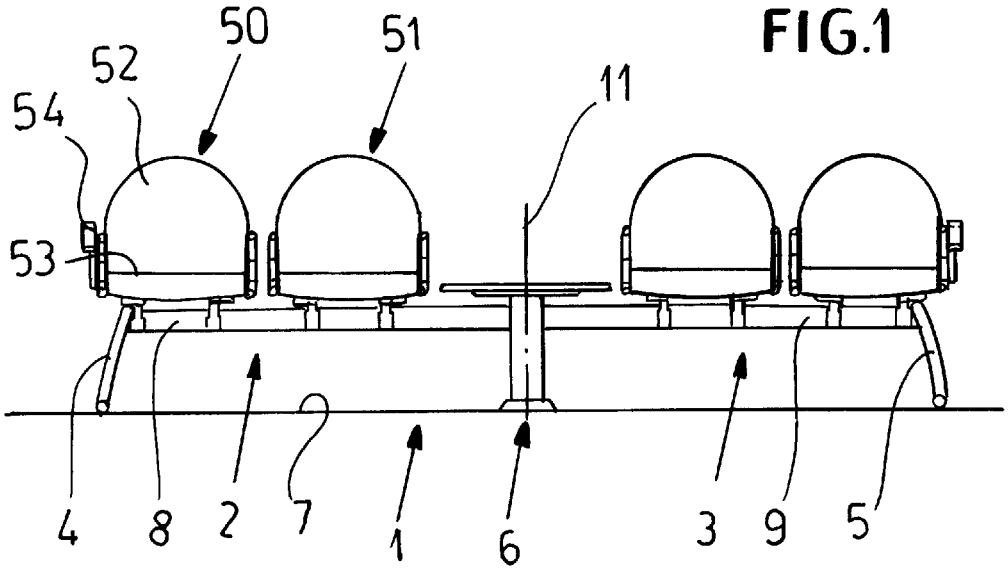
FIG. 1 is a front view of a seat assembly according to the invention having two bench-type seating units diametrically opposite one another and oriented in the same direction with a central pedesta or support according to the invention.

FIG. 1 shows a seating assembly 1 which can be used for row seating, i.e. alignment of a number of these seating units in a single row or a multiplicity of such units in a number of rows one behind the other, or for connection to other similar seating assemblies in a variety of patterns including those of FIGS. 4–6. The assembly of FIG. 1 comprises two seating units 2, 3, each of which is a bench-type seating unit with a pair of seats 50 and 51, each with a backrest 52, a seating surface 53 and armrests or a single armrest 54 for the particular unit. The assembly has a pair of outer supports or legs 4 and 5 and a common or central support 6 enabling the assembly to rest upon a floor surface 7. The assembly as a whole has been represented at 1.

While each of the seating units 2, 3 has been shown to comprise two seats in a row, it will be understood that a single seat can be used and that more than two seats can be provided. The seating units have respective support frames 8 or 9 to which the seats can be bolted.

Figure 2:
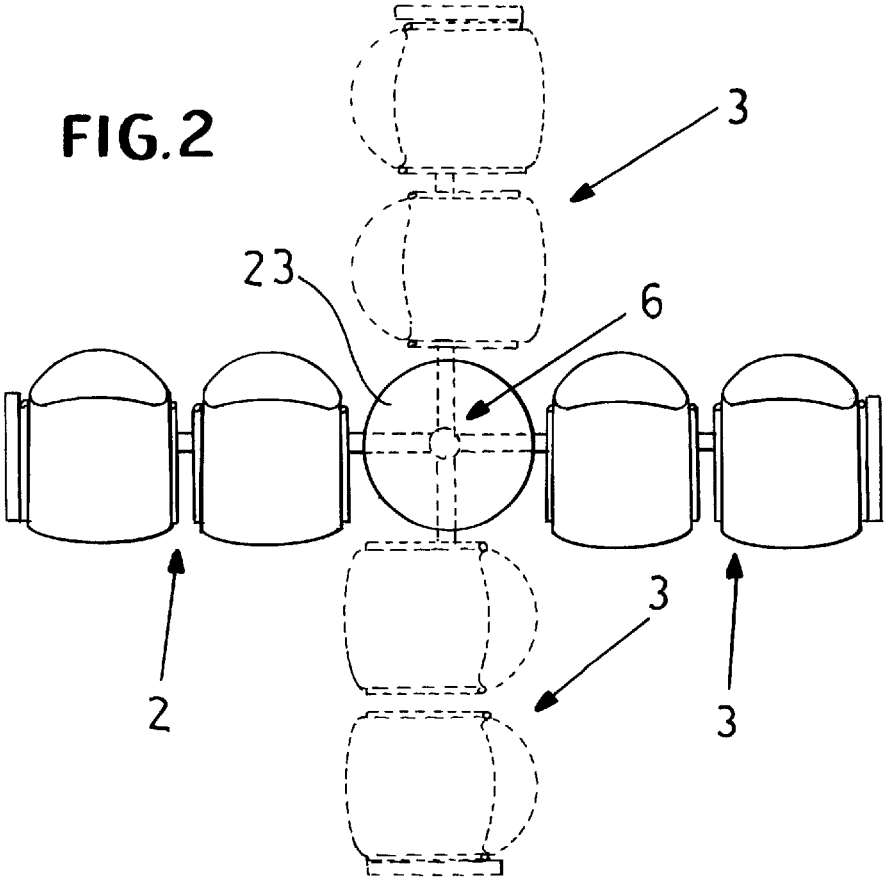
FIG. 2 is a plan view of the assembly of FIG. 1 with alternative positions of the seating units shown in broken lines.
Figure 3:
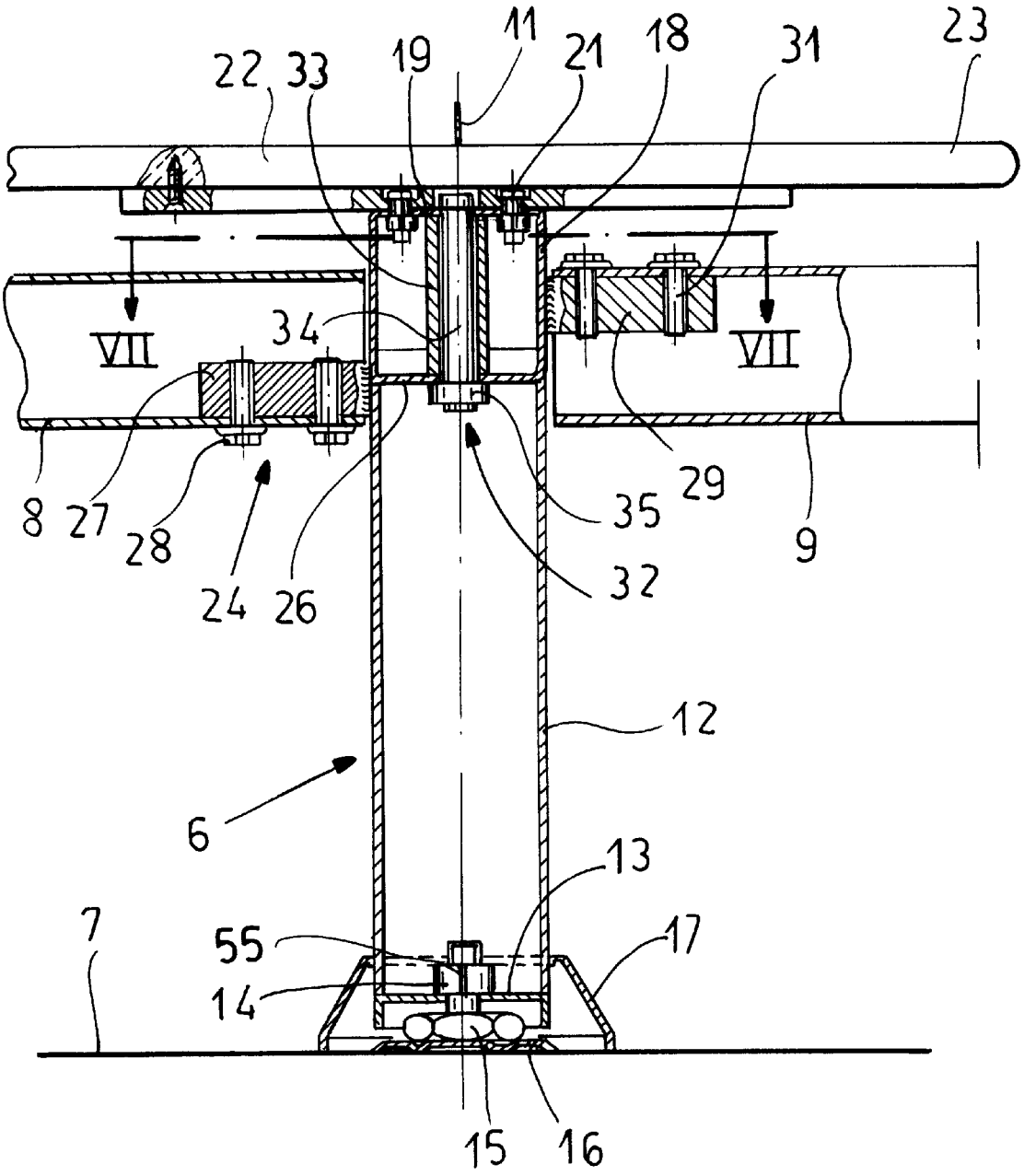
FIG. 3 is a cross sectional view drawn to a larger scale of the central support.
Figure 7:
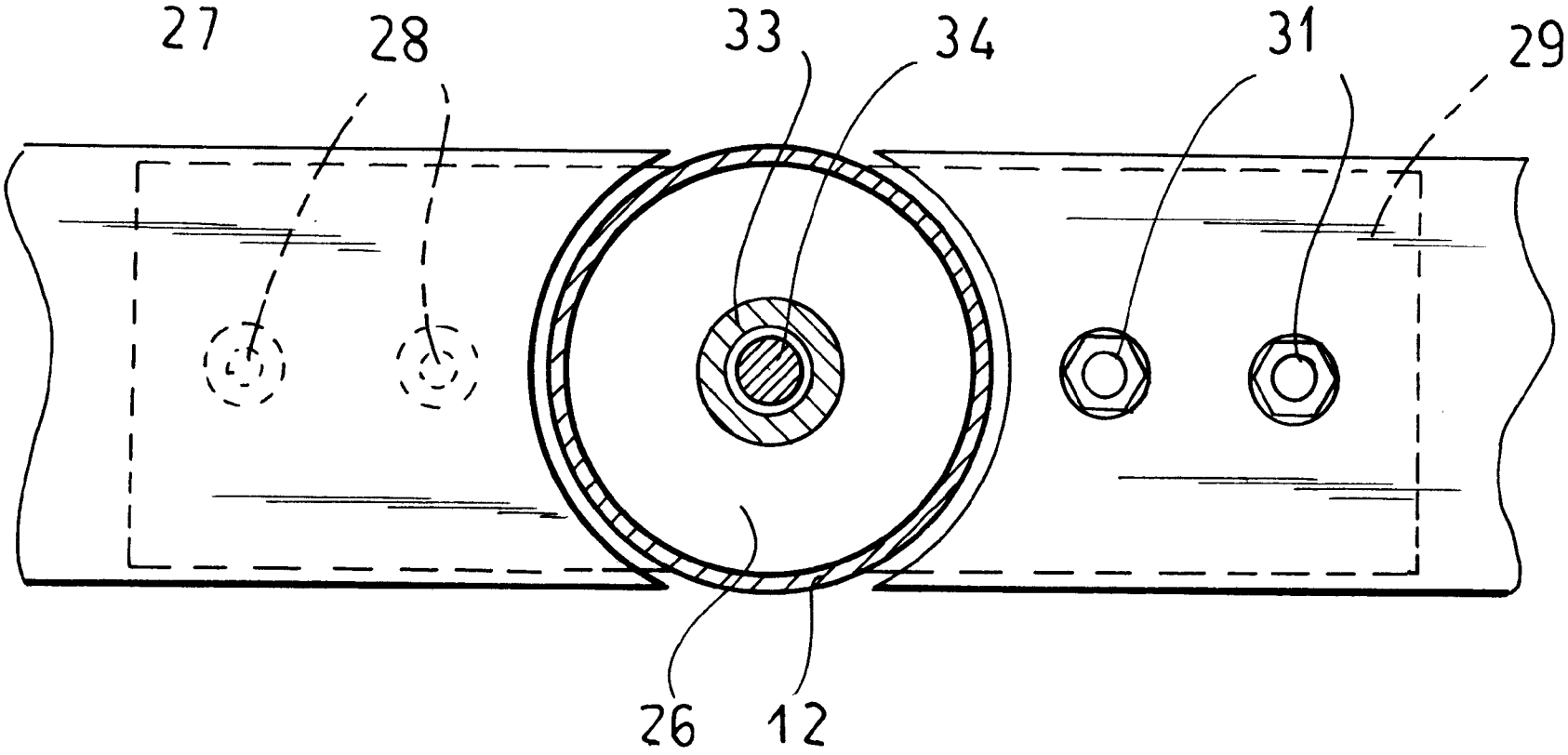
FIG. 7 is a cross sectional view taken along the line VII—VII of FIG. 3.

According to the invention and is shown in greater detail in FIGS. 3 and 7, the central support 6 is provided as a pivot joint with a substantially vertical joint axis 11 about which the seating units 2 and 3 can be swung into different orientations as has been shown diametrically in FIG. 2. It will be apparent that the seating units 2 and 3 can form an angle of 180° between them, i.e. can be diametrically opposite one another, or that the unit 3 can be swung in the clockwise or counter-clockwise sense relative to the unit 2 about the axis 11 to lie at 90° to the unit 2. Any intermediate angle can also be assumed by the unit 3 (compare the broken lines with the solid lines).

As can be seen from FIGS. 3 and 7, the central support 6 comprises a support column 12 which is formed in the region of its lower end with a central annular disk 13 which receives the height-adjusting screw 14 for a foot formed by the locking ring 16 which is engaged by the head 15 of a screw 14.

The screw 14 can be threaded into a nut 55 welded to the disk 13. The nut 15 can have formations which engage formations of the plate 16 to prevent slipping of the head 15 relative to the plate 16 when the column is braced against the floor.

The lower end of the support column 12 is covered by a protective cap 17. At the upper end of the column 12, a cap-shaped support housing 18 is provided. The housing 18 has an upper end wall 19 affixed by bolts 21 to a support plate 22 which, in turn, carries the table 23. As will be apparent from FIG. 2, this table is at least approximately round or circular so that it does not create a hinderance to swinging of the seating units 2 and 3 relative to one another into the various positions described.

At the upper end of the support column 12 and on the housing 18, respective plug connections 24 and 25 are provided for engagement in the support frames 8 and 9 of the respective seating units. The plug connection 24 of the column 12 has a radial arm 27 welded to the column and digitally connected by screws 28 with the support frame 8 for the seating unit 2. The plug connection 25 comprises a radial downwardly extending support arm 29 welded to the housing 18 and connected by the screws 31 with the support frame 9 of the seating unit 3.

To clamp the seating units in the angular position in which they are adjusted, a clamping device 32 is provided. The latter comprises a spacing sleeve 33 braced between the end wall 19 of the housing 18 and an end wall formed by an insert 26 welded to the column 12. A clamping bolt 34 passes through the sleeve 33 and the end walls 19 and 26 and is engaged by a nut 35.

After removal of the table 23, by loosening of the clamping bolt 34, one of the seating units can be swung relative to the other about the axis 11 and then, by tightening of the nut 35 or the bolt 34, that position can be secured.

FIGS. 4–6 show a number of positioning variants for the assembly of FIGS. 1–3 which can be joined together with other similar assemblies and with intervening support units 6 and tables 23. For example, FIG. 4 shows an approximately Z shaped pattern or S shaped pattern with all of the seating units oriented in the same general direction, i.e. downwardly as seen in FIG. 4.

In FIG. 5, a somewhat semicircular pattern is shown and, of course, the seating assemblies can be joined to form an approximately circular pattern as may be desired.

In FIG. 6, a pattern similar to that of FIG. 4 is shown wherein, however, the seats of the bench units are oriented in opposite directions alternately along the assembly. Of course the invention is not limited to these seating patterns and indeed any seating pattern consistent with joining multiple assembles and orienting the seating units of those assemblies in different directions and at different angles, and providing various numbers of seats per seating unit, can afford high versatility and great variety with respect to additional seating arrangements.

I claim:

1. A seating system comprising:

a support defining a vertical axis;

at least two seating units connected to said support and adjustable angularly thereon about said axis to form a freely selectable angle between said seating units; and means on said support for locking said seating units relative to one another and to said support at said freely selectable angle, each of said seating units comprising a frame and a row of seats on said frame, said support comprising a tubular column having a foot resting upon a floor surface, and a tubular housing on said column and aligned therewith to bear directly on the column, one of said frames being secured to said column and another of said frames being secured to said housing, said means on said support for locking said seating units relative to one another and to said support at said angle including means for clamping said housing to said column, said column being provided with a lower member welded thereto and extending radially from said column and to which said one of said frames is secured, said housing having an upper member welded thereto and projecting radially from said housing and to which said other of said frames is secured, said upper member being spaced above said lower member and said upper and lower members being secured respectively to said fames at upper and lower portions thereof.

2. The seating system defined in claim 1 wherein said housing and said column are each provided with a respective plug connector engaging in a respective one of said frames and secured thereto, said plug connectors forming said upper and lower members.

3. The seating system defined in claim 2 wherein said means for clamping includes a sleeve braced between an end wall of said housing and an end wall of said column, a clamping screw extending through said end walls and said sleeve, and a nut threaded on said screw.

4. The seating system defined in claim 3, further comprising a support plate removably fastened on said end wall of said housing.

5. The seating system defined in claim 4, further comprising a table on said support plate.

6. The seating system defined in claim 5 wherein said table is at least approximately circular.

7. A seating system comprising:

a support defining a vertical axis;

at least two seating units connected to said support and adjustable angularly thereon about said axis to form a freely selectable angle between said seating units; and means on said support for locking said seating units relative to one another and to said support at said freely selectable angle, each of said seating units comprising a frame and a row of seats on said frame, said support comprising a column having a foot resting upon a floor surface, and a housing on said column, one of said frames being secured to said column and another of said frames being secured to said housing, said means on said support for locking said seating units relative to one another and to said support at said angle including means for clamping said housing to said column, said housing and said column each being provided with a respective plug connector engaging in a respective one of said frames and secured thereto, said plug connector of said column extending radially from said column at an upper end thereof and the plug connector of said housing extending radially therefrom, said plug connectors being welded respectively to said column and said housing, said means for clamping including a sleeve braced between an end wall of said housing and an end wall of said column, a clamping screw extending through said end walls and said sleeve, and a nut threaded on said screw, a support plate being removably fastened on said end wall of said housing, and an approximately circular table on said support plate, said foot being formed with a disk at a bottom of said column, a bracing screw threaded into said disk and having a head below said disk, and a retainer spring ring engaged by said head.

8. A seating system comprising:

a support defining a vertical axis;

at least two seating units connected to said support and adjustable angularly thereon about said axis to form a freely selectable angle between said seating units; and means on said support for locking said seating units relative to one another and to said support at said freely selectable angle, each of said seating units comprising a frame and a row of seats on said frame, said support comprising a column having a foot resting upon a floor surface, and a housing on said column, one of said frames being secured to said column and another of said frames being secured to said housing, said means on said support for locking said seating units relative to one another and to said support at said angle including means for clamping said housing to said column, said foot being formed with a disk at a bottom of said column, a bracing screw threaded into said disk and having a head below said disk, and a retainer spring ring engaged by said head.

9. The seating system defined in claim 8 wherein said housing and said column are each provided with a respective plug connector engaging in a respective one of said frames and secured thereto.

10. The seating system defined in claim 9 wherein said plug connector of said column extends radially from said column at an upper end thereof and the plug connector of said housing extends radially therefrom.

11. The seating system defined in claim 9 wherein said plug connectors are welded respectively to said column and said housing.

12. The seating system defined in claim 11 wherein said means for clamping includes a sleeve braced between an end wall of said housing and an end wall of said column, a clamping screw extending through said end walls and said sleeve, and a nut threaded on said screw.

13. The seating system defined in claim 12, further comprising a support plate removably fastened on said end wall of said housing.

14. The seating system defined in claim 13, further comprising a table on said support plate.

15. The seating system defined in claim 14 wherein said table is at least approximately circular.

* * * * *